US005267704A

United States Patent [19]

Kitamura et al.

[11] Patent Number: 5,267,704

[45] Date of Patent: Dec. 7, 1993

[54] PAPER ROLL SUPPORTING AND HOLDING DEVICE WITH EXPANSIBLE END SUPPORT MEMBER

[75] Inventors: Michio Kitamura, Ishikawa; Toshiaki Kouyama, Saitama, both of Japan

[73] Assignee: Fuji Xerox Co., Ltd., Tokyo, Japan

[21] Appl. No.: 727,107

[22] Filed: Jul. 9, 1991

[30] Foreign Application Priority Data

Jul. 19, 1990 [JP] Japan ..... 2-76733

[51] Int. Cl.[5] ..... B65H 75/18; B65H 16/02

[52] U.S. Cl. ..... 242/72 R; 242/68.2

[58] Field of Search ..... 242/68.4, 72 R, 68, 242/68.2, 68.5

[56] References Cited

U.S. PATENT DOCUMENTS

| | | | |
|---|---|---|---|
| 1,885,192 | 11/1932 | Elssner et al. | 242/72 X |
| 1,941,495 | 1/1934 | Schoultheis | 242/68 |
| 2,134,475 | 10/1938 | Green | 242/72 |
| 2,219,124 | 10/1940 | Bandy | 242/72 R |
| 2,917,249 | 12/1959 | MacLelland | 292/68.4 |
| 3,157,405 | 11/1964 | Hafemeister | 242/68.2 X |
| 3,667,696 | 6/1972 | McCarthy | 242/72 |
| 4,315,608 | 2/1982 | Bettenhausen | 292/68.2 |
| 4,339,094 | 7/1982 | Thievessen et al. | 242/72 R |
| 4,512,079 | 4/1985 | LeBlond | 292/68.2 |
| 4,795,106 | 1/1989 | Weiss et al. | 242/72 R |
| 4,971,265 | 11/1990 | Koch | 242/72 R |

FOREIGN PATENT DOCUMENTS

| | | | |
|---|---|---|---|
| 0096494 | 12/1983 | European Pat. Off. . | |
| 0133639 | 3/1985 | European Pat. Off. . | |
| 0305738 | 3/1989 | European Pat. Off. . | |
| 2850560 | 4/1980 | Fed. Rep. of Germany . | |
| 2910114 | 9/1980 | Fed. Rep. of Germany | 242/72 R |
| 58-69108 | 11/1983 | Japan . | |
| 1-229657 | 9/1989 | Japan . | |

*Primary Examiner*—Daniel P. Stodola
*Assistant Examiner*—John Rollins
*Attorney, Agent, or Firm*—Finnegan, Henderson, Farabow, Garrett & Dunner

[57] ABSTRACT

A supporting and holding device in which end supporting members are coupled to both ends of a core of a roll of paper, and are then supported by holding members in the sheet supplying section of an image forming apparatus. Flanges of the end supporting members enable the roll of paper to roll with the aid of the holding member, so as to supply a sheet of paper from the roll of paper. Each end supporting members includes a main member which is inserted into the core of the roll of paper, and an auxiliary member which is inserted into the main member. The main member has a plurality of arm members which are inserted into the core of a roll of paper; and a first flange member integral with the arm members is to be and is to be positioned outside the roll of paper. The first flange includes an axial through-hole extending therethrough. The auxiliary member has a second flange; and a pipe-shaped member which is integral with the second flange. The pipe-shaped member includes a set of first protrusions and is configured to be inserted into the axial through-hole of the main member to push the arm members of the main member against an inner wall of the core when the auxiliary member is rotated through a predetermined angle, thereby securing the end supporting members to both ends of the roll of paper.

9 Claims, 7 Drawing Sheets

| WEIGHTS OF ROLLS OF PAPER (kg) | RESISTANCES AGAINST THE DRAWING OF SHEETS OF PAPER FROM THE ROLLS OF PAPER (kg·f) |
|---|---|
| 12.170 | 1.484 |
| 8.596 | 1.048 |
| 6.078 | 0.748 |
| 4.298 | 0.524 |

PAPER ROLL SUPPORTING AND HOLDING DEVICE WITH EXPANSIBLE END SUPPORT MEMBER

BACKGROUND OF THE INVENTION

This invention relates to a supporting and holding mechanism for use in an image forming apparatus, such as a copying machine, which is adapted to hold a roll of paper with flange members connected to both ends of the roll of paper, and more particularly to a holding device which can be easily engaged with both ends of a roll of paper and which can positively support the roll of paper.

In general, an image forming apparatus, such as a copying machine or a printer, employs sheet supplying means in which a number of sheets of paper cut to a predetermined size are accommodated in a sheet accommodating means, such as a sheet supplying cassette or a sheet tray.

On the other hand, an electronic copying machine or a facsimile system, which may require large sheets of paper, employs a cutting device together with a roll of paper so that a recording sheet can be formed freely according to the size of a given original.

In a copying machine disclosed, for instance, by Japanese Patent Application (OPI) No. 220657/1989 (the term "OPI" as used herein means an "unexamined published application"), a plurality of rolls of paper are loaded in the sheet supplying section. The rolls thus loaded may be of tracing paper, ordinary paper, etc. In response to the kind of paper selected by the operator and the size of an original, one of the rolls of paper is selected, and a sheet of paper is supplied from the roll thus selected to the image transferring section.

In addition, in the conventional copying machine, a cutter or the like is provided at the sheet supplying section, to cut the paper thus supplied to a necessary length.

In the copying machine thus constructed, a roll of paper is set in the sheet supplying section, as follows. A supporting shaft is inserted into the roll of paper, and both ends of the supporting shaft are supported with supporting members provided on both sides of the sheet supporting section.

Tensioning means is provided for the supporting shaft or the roll of paper at a predetermined part, so that the sheet supplying operation is carried out under a predetermined tension value irrespective of the amount of paper remaining in the roll.

The above-described sheet supplying unit, which uses rolls of paper, is disadvantageous for the following reason. When it is required to insert the supporting shaft into a roll of paper which is larged in size, such as a roll of paper of A0 size, the work cannot be performed without a large space, and the work itself is troublesome.

On the other hand, a method has been employed by a facsimile system or the like in which flange members are engaged with both ends of a roll of paper, and the flange members thus engaged are rotatably supported on supporting members.

In this case, generally the flange members each comprise: a flange large in diameter; and a pipe-shaped portion extended from the flange. The pipe-shaped portions are inserted into the core of a roll of paper, and the flanges are rotatably positioned on the supporting members. In order to accurately position the flanges on the supporting members, it is necessary to provide supporting means corresponding to the size of paper; however, the provision of the supporting means may make the sheet supplying section intricate in construction.

Furthermore, the employment of the above-mentioned members may suffer since the pipe-shaped portions are not always sufficiently engaged with the core of the roll of paper; that is, it is difficult for the pipe-shaped portions to positively support the roll of paper at all times.

SUMMARY OF THE INVENTION

An object of this invention is to eliminate the above-described difficulties accompanying a conventional holding means for a roll of paper. More specifically, an object of the invention is to provide a supporting and holding device for a roll of paper comprising end supporting members relatively simple in construction which can be positively coupled to both ends of a roll of paper.

According to the present invention, a supporting and holding device is provided wherein end supporting members are configured to be coupled to both ends of a core of a roll of paper. The end supporting member and are then capable of being supported by the holding member in a sheet supplying section, and flanges of the end supporting members enable the roll of paper to roll with the aid of the holding member to supply a sheet of paper from the roll of paper. Each of the end supporting members includes a main member which is configured to be inserted into the core of a roll of paper and an auxiliary member which is configured to be inserted into the main member. The main, member includes a plurality of arm members which are configured to be inserted into the core of a roll of paper; a first flange member integral with the arm members which is relatively large in diameter and is configured to be positioned outside the roll of paper; and an axial through-hole. The auxiliary member includes a second flange relatively large in diameter; and a pipe-shaped member which is integral with the second flange and is configured to be inserted into the axial through-hole of the main member, the pipe-shaped member having a set of first protrusion, members, provided thereon. In addition, the auxiliary members is configured to be turned through a predetermined angle so that the set of first protrusion members push the arm members against an inner wall of the core, thereby securing the end holding members to both ends of the roll of paper.

This invention further concerns a supporting and holding device for a roll of paper in which end supporting members are coupled to both ends of the core of a roll of paper, and are then supported by holding means in a sheet supplying section, wherein the flanges of the end supporting members enable the roll of paper to roll with the aid of the supporting holding means to permit a sheet of paper to be drawn from the roll of paper.

In the supporting and holding device of the present invention each of the end supporting members comprises a main member which is inserted into the core of a roll of paper; and an auxiliary member which is inserted into the main member. The main member comprises a plurality of arm members which are inserted into the core of a roll of paper. A first flange member integral with the arm members, the first flange member relatively large in diameter and positioned outside the roll of paper; and an axial through-hole. The auxiliary member is made up of a second flange relatively large in diameter, and a pipe-shaped member which is integral with the second flange and is inserted into the axial through-hole of the main member.

To assemble the supporting device, the auxiliary members are each turned through a predetermined angle so that protrusion members formed on the pipe-shaped member push the arm members against the inner wall of the core, thereby securing the end supporting members to both ends of the roll of paper.

Further in accordance with the present invention, locking means, namely pawl members, are formed on the bases of the main member and the auxiliary member. When the end supporting member releases the roll of paper, the main member and the auxiliary member are locked to each other by the locking means so that they may not be separated from each other.

In the end supporting members thus constructed, the supporting means is relatively simple in construction. The end supporting members can be readily engaged with and disengaged from a roll of paper.

With the supporting and holding device according to the invention, the end supporting members can be properly coupled to a roll of paper when the auxiliary members are turned to engage end supporting members engaged with both ends of the roll of paper. And the roll of paper thus supported can be properly loaded in the sheet supplying section of a copying machine or the like.

BRIEF DESCRIPTION OF THE DRAWINGS

FIG. 3(*b*) is the cross-sectional view of FIG. 3(*a*), with the auxiliary member turned to engage the arm members with the core of the roll.

FIG. 3(*c*) is a cross-sectional view of the base of the end supporting member taken along line 3*c*—3*c* of FIG. 2, with the pawl members in engagement.

FIG. 3(*d*) is the end view of FIG. 3(*c*), with the pawl members out of engagement.

FIG. 4(*b*) is an end view of a lock lever on the end supporting member in the locked position.

FIG. 4(*c*) is the end view of FIG. 4(*b*), with the lock lever in the unlocked position.

DETAILED DESCRIPTION OF THE PREFERRED EMBODIMENTS

A supporting and holding device for a roll of paper, which constitutes one embodiment of this invention, will be described with reference to the accompanying drawings.

Figure 1:
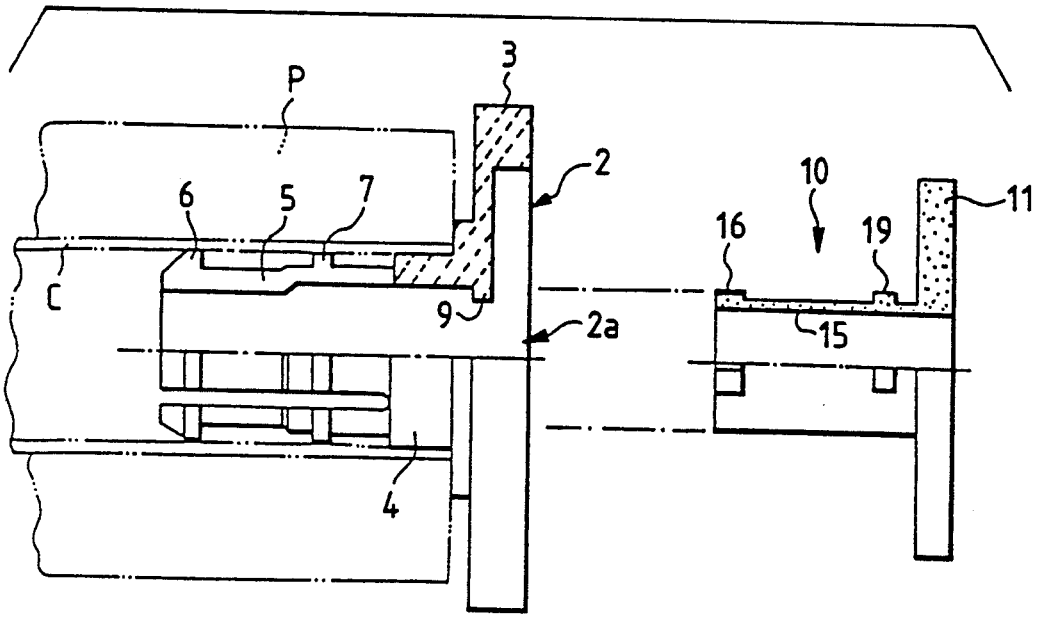
FIG. 1 is an exploded sectional side view showing components forming an end supporting member according to the invention.

In the embodiment shown in FIG. 1, an end supporting member 1 is made up of a main member 2 and an auxiliary member 10. In operation, a pair of end supporting members 1 are inserted into the end portions of the core of a roll of paper P (hereinafter referred to merely as "a roll P", when applicable); that is, they are engaged with both end portions of the roll P through the core C.

The main member 2 comprises a large diameter flange 3 which is positioned outside the roll P; a cylindrical barrel 4 which is inserted into the core; and a plurality of arm members 5. The main member 2 has a through-hole 2*a* extended along its central axis.

The arm members 5 protrude from the barrel 4. In the embodiment, three arm members 5 are arranged at equal angular intervals as shown in FIG. 3.

Each arm member 5 of the main member 2 has an end protrusion 6 and a protrusion member 7 on its surface which are configured to confront the core. More specifically, the end protrusion 6 is formed at the end of the arm member 5, and the protrusion member 7 is formed near the base of the arm member 5. When the arm members 5 are urged outwardly, the end protrusions 6 and the protrusion members 7 push against the inner wall of the core C strongly, thereby positioning the end supporting member.

The auxiliary member 10 is inserted into the through-hole 2*a* of the main member 2. The auxiliary member 10 includes a flange 11 and a pipe-shaped member 15 integral with the flange 11. Protrusion members 16 are formed on the pipe-shaped member 15 at the end, and outer pawl members 19 are formed on the pipe-shaped member 15 near the base.

The auxiliary member 10 is rotatably inserted into the through-hole 2*a* of the main member 2. By rotating the auxiliary member 10, the protrusion members 16 and the outer pawl members 19 may be positioned in phase with the arm members of the main member 2.

Figure 2:
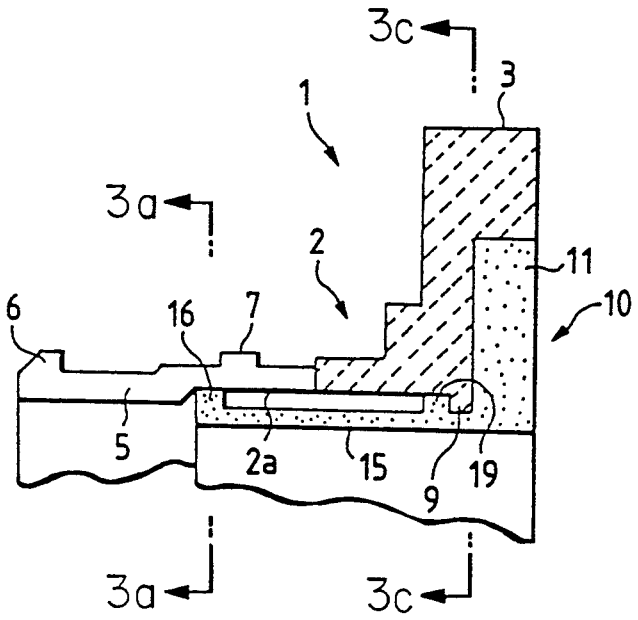
FIG. 2 is a partial sectional view showing the end supporting member.
Figure 3A:
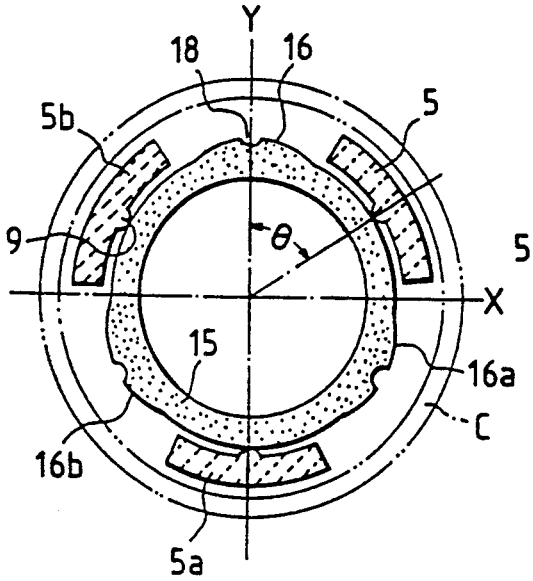
FIG. 3(*a*) is a cross-sectional view of the end supporting member taken along line 3*a*—3*a* of FIG. 2, with the arm members out of engagement with the core of the roll.
Figure 3B:
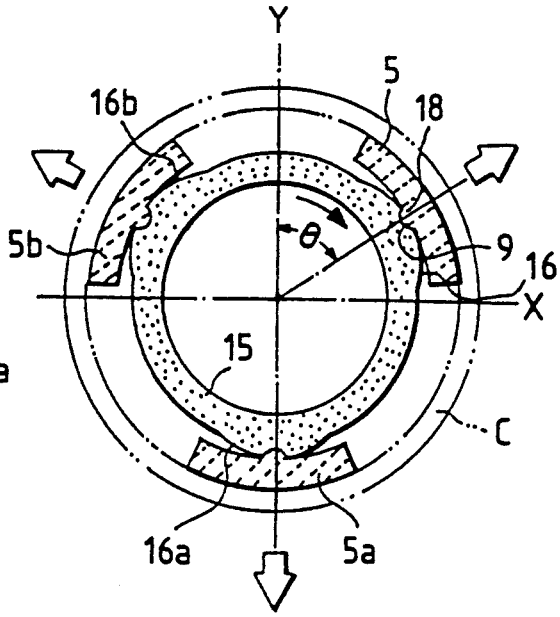
Figure 3C:
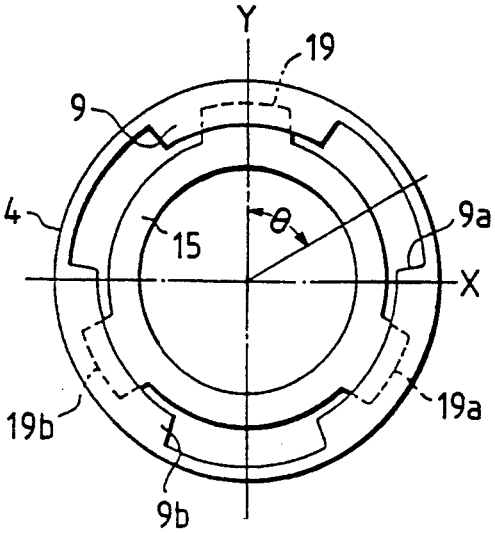
Figure 3D:
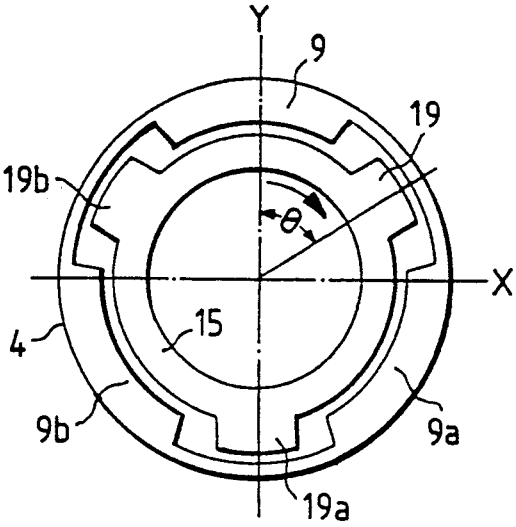

FIG. 2 shows the main member 2 and the auxiliary member 10 engaged together. When the auxiliary member 10, after being inserted into the main member 2 as shown in FIG. 2, is turned until the protrusion members 16 of the pipe-shaped member 15 meet the arm members 5, the protrusion members 16 push the arm members 5 radially outwardly.

As the arm members 5 are pushed in this manner, the end protrusions 6 and the protrusion members 7 of the arm members 5 strongly push against the inner wall of the core C of the roll P, whereby the end supporting member 1 is positively secured to the roll P. In the case of FIG. 2, the protrusion members 16 are engaged with the inner surfaces of the arm members 5 so as to push the latter 5 radially outwardly.

Conversely, when the auxiliary member 10 is turned through a predetermined angle in the main member 2 to release the roll of paper P, the outer pawl members 19 formed on the pipe-shaped member 15 near the base engage the inner pawl members 9 formed on the inner wall of the barrel 4 of the main member 2, thus preventing the auxiliary member 10 from coming off the main member 2.

For simplification in description, the arm members 5 and the inner pawl members 9 are shown in FIGS. 1 and 2 as if they were on one and the same axial line; however, it should be noted that in practice they are arranged as shown in FIGS. 3(*a*)-(*d*).

As shown in the FIGS. 3(*a*)-3(*d*), the end supporting members support the roll, and, when the roll is released by turning the auxiliary members, the auxiliary members are prevented from coming off the main members.

More specifically, the FIGS. 3(*a*) and 3(*b*) are cross-sectional views taken along line 3*a*—3*a* in FIG. 2, showing operations of moving the arm members into and out of engagement with the inner wall of the core. In FIG. 3(*a*), the end supporting member is inserted into the core of the roll of paper; while in FIG. 3(*b*), the end supporting member is fixedly secured to the core of the roll of paper.

As seen in FIG. 3(*b*), the main member has three arm members 5 which are arranged at angular intervals of 120° C., and in correspondence with arm members, the pipe-shaped member 15 has three protrusion members 16 which are also arranged at angular intervals of 120° C.

Each of the protrusion member 16 has a recess 18 at the middle. The arm members 5 have protrusions 8 in such a manner that the protrusions 8 are engageable with the recesses 18 in the protrusion members 16, respectively. As is seen in FIG. 3(*b*), the protrusions 8 and the recesses 18 act to position the protrusion members 16 with respect to the arm members 5.

The provision of the protrusions 8 and the recesses 18 ensures that, when the auxiliary member is turned, its stop position is accurately determined. Furthermore for the same reason, when the operator turns the auxiliary member, he can readily control the rotation of the auxiliary member.

As is seen from FIGS. 3(*a*) and 3(*b*), in securing the end supporting member to the core of the roll of paper, the auxiliary member held as shown in FIG. 3(*a*) is turned through a predetermined angle $\theta$. In the embodiment of FIG. 3, the predetermined angle $\theta$ is 60°; that is, the auxiliary member 10 is turned through 60°.

FIGS. 3(*c*) and 3(*d*) show a locking mechanism which, when the auxiliary member 10 is turned to disengage the arm members 5 of the main member 2 from the core of the roll, operates to hold the auxiliary member 10 inside the main member 2.

In order to hold the auxiliary member 10 inside the main member 2, use is made of the inner pawl members 9 protruding from the inner wall of the barrel 4 of the main member, and the outer pawl members 19 protruding from the base of the pipe-shaped member 15 of the auxiliary member 10. FIGS. 3(*c*) and 3(*d*) are cross sectional views, taken along line 3*c*—3*c* in FIG. 2. With respect to the X-axis and the Y-axis, the members shown in FIGS. 3(*c*) and 3(*d*) are in phase, i.e., same angular position, as those shown in the FIGS. 3(*a*) and 3(*b*), respectively.

In the case of the FIG. 3(*c*), the arm members 5 are not in operation; that is they are not engaged with the core C as shown in the FIG. 3(*a*), and the inner pawl members 9 are overlapped with the outer pawl members 19. The inner pawl members 9, which are shifted in phase from the arm members 5, by the angle $\theta$, respectively, are engaged with the outer pawl members 19, in the axial direction, respectively, which are in alignment with the protrusion members 16 of the pipe-shaped member 15.

When the auxiliary member is inserted into the main member, the inner pawl members 9 are positioned outside the outer pawl members 19, so as to prevent the auxiliary member from coming off the main member.

FIG. 3(*d*) shows, the arm members are pushed against the core of the roll of paper. Under this condition, the auxiliary member will not come off the main member, and accordingly it is unnecessary to engage the inner pawl members with the outer pawl members.

The end supporting member may be coupled to the core of the roll of paper, as follows; First, the auxiliary member is coupled to the main member as shown in FIG. 3(*d*), and then it is turned through the predetermined angle $\theta$ as shown in FIG. 3(*c*). This method facilitates the connection of the end supporting member to the core of the roll of paper.

Figure 4A:
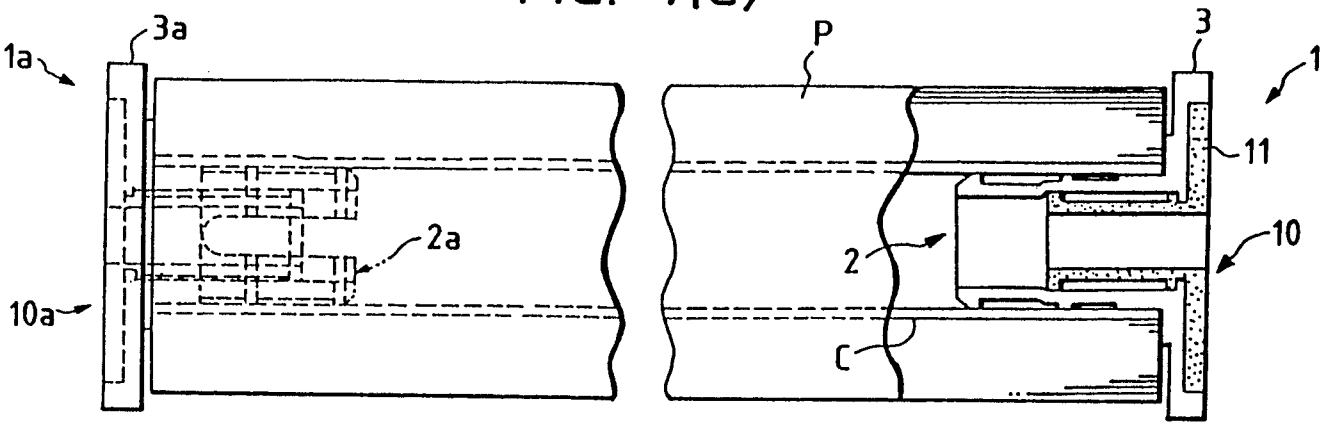
FIG. 4(*a*) is a partially sectional side view of the supporting and holding device of the present invention in cooperation with a roll of paper.
Figure 4B:
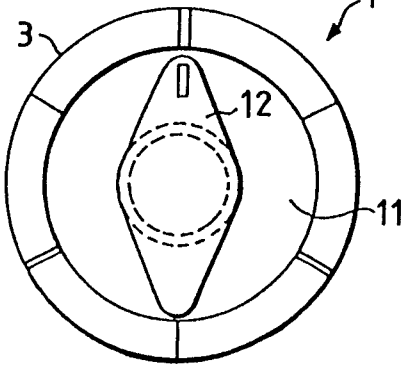
Figure 4C:
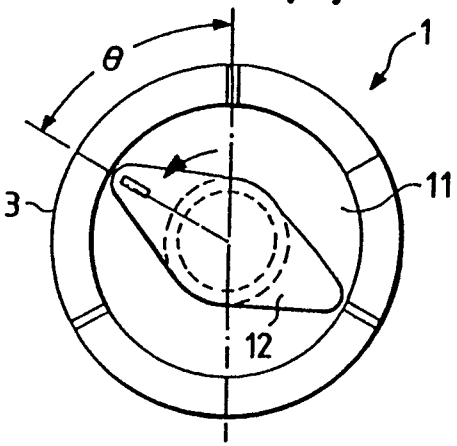

The end supporting members thus constructed are coupled to the roll of paper P as shown in FIG. 4. As shown in FIG. 3(*a*), the identical end supporting members 1 and 1*a* are inserted into both end potions of the paper P, respectively, and are then rotatably positioned on roll-of-holding means which is provided at the sheet supplying section of an image forming apparatus. In this positioning operation, the flanges 3 and 3*a* are utilized which are larger in diameter than the roll of paper P.

In order that, after the auxiliary member 10 is inserted into the main member 2, the arm members 5 are fixed by the protrusion members 16 of the pipe-shaped member 15, as shown in FIG. 4(*b*), a lock lever 12 provided for the flange of the auxiliary member 10 is turned to a predetermined position. A such, it can be visually confirmed that the end supporting member is in a locking condition.

When, under this condition, the lock lever 12 is turned through the angle 8 as shown in FIG. 4(*c*). It can be visually detected that the locking condition has been eliminated.

The lock lever 12 may be provided for the flange 3 in various manners. For instance, the lock lever 12 may be protruded from the flange 3, or the flange 3 may be etched to form the lock lever 12.

In the above-described embodiment, the pipe-shaped member 15 of the auxiliary member 10 is circular in section; however, it should be noted that the invention is not limited thereto or thereby. That is, the pipe-shaped member 15 may be substantially triangular in section for instance. In this case, it goes without saying that the pipe-shaped member should have protrusions at the end which function in the same manner as those in the above-described embodiment, to move the arm members outwardly. It should be noted that, in this case, it is essential that the pipe-shaped member has a cylindrical base on the side of the flange so that the auxiliary member may be rotatably held in the main member.

Figure 5:
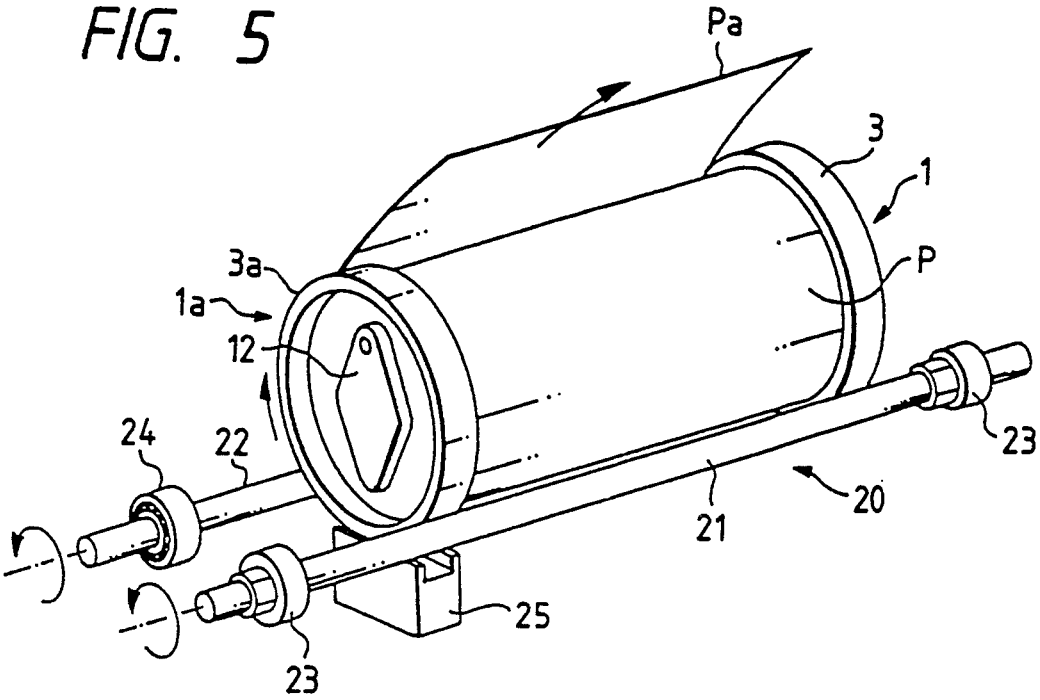
FIG. 5 is a perspective view of the supporting and holding means according to the invention in a sheet supplying section.
Figure 6:
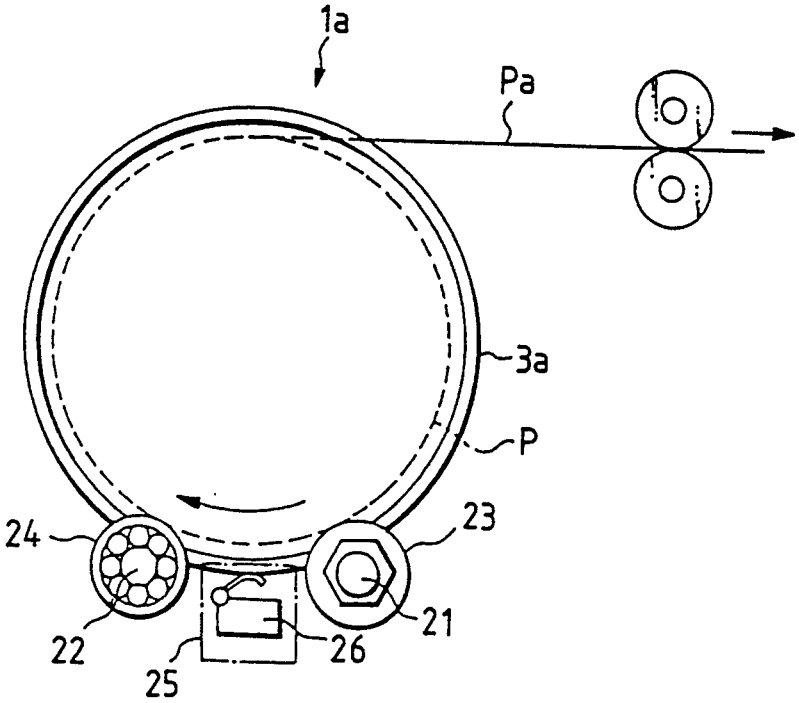
FIG. 6 is a side view of the supporting and holding means of FIG. 5.

The supporting device thus constructed is positioned on a holding member 20 provided in the sheet supplying section of the image forming apparatus as shown in FIGS. 5 and 6.

The holding member 20 comprises two shafts 21 and 22 arranged in parallel with each other. The two shafts 21 and 22 are supported through bearing means comprising slide bearings 23 and ball bearings 24. The shafts thus supported are used to support a roll of paper.

Figures 10A, 10B:
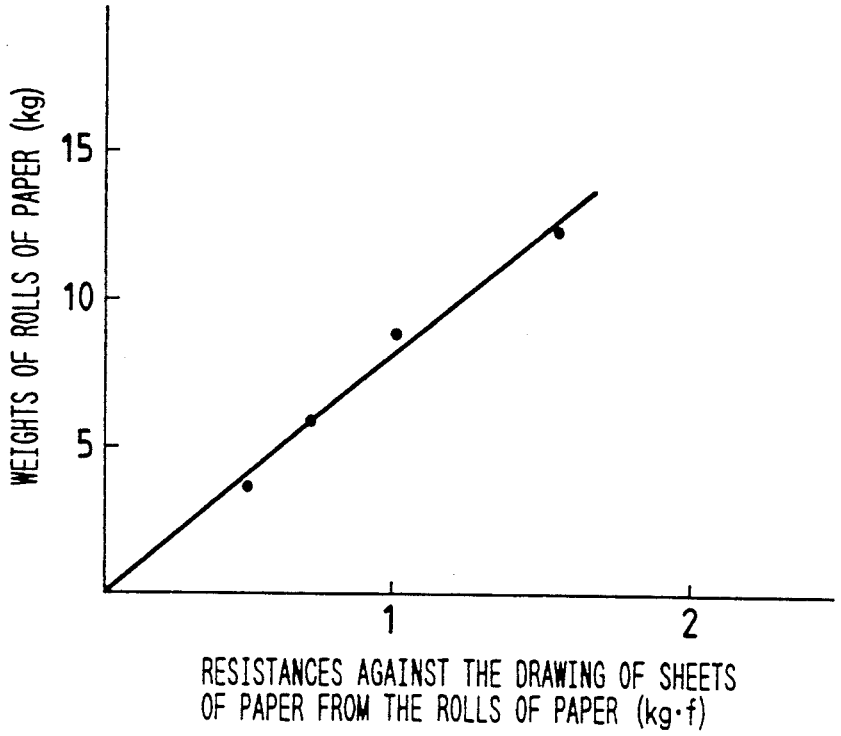
FIGS. 10(*a*) and 10(*b*) are a table and a graphical representation, respectively, of a description of the relationships between the weights of rolls of paper and the resistances against the drawing of sheets of paper from the rolls of paper.

When the shaft 21 is rotated, the slide bearings 23 provides rotational resistance according to the weight of the roll of paper applied to the shaft 21. That is, the motion of drawing a sheet of paper Pa from the roll is resisted in proportion to the weight of the paper forming the roll. FIGS. 10(*a*) and 10(*b*) show a table and a graphical representation, respectively, for a description of the relationships between the weights of rolls of paper and the resistances against the motion of drawing sheets of paper from the roll of paper.

A positioning member 25 is disposed between the two shafts 21 and 22. More specifically, it is set according to the paper size of the roll of paper. The position member 25 is arranged so as to lock the flange 3*a* of the main member. A plurality of positioning members may be provided when a plurality of paper sizes are handled.

The positioning member 25 may be provided with a sensor 26. In this case, means may be provided which, in response to the detection signal which the sensor outputs upon detection of the flange of the main member, causes the display section of the image forming apparatus to display the paper size of the roll of paper which is set in the sheet supplying section.

As was described above, the roll of paper is supported with the two shafts, and the flange of one of the end supporting members is set with the positioning member. Hence, the sheet of paper drawn from the roll is forwarded to the paper conveying path while being correctly positioned.

Figure 7:
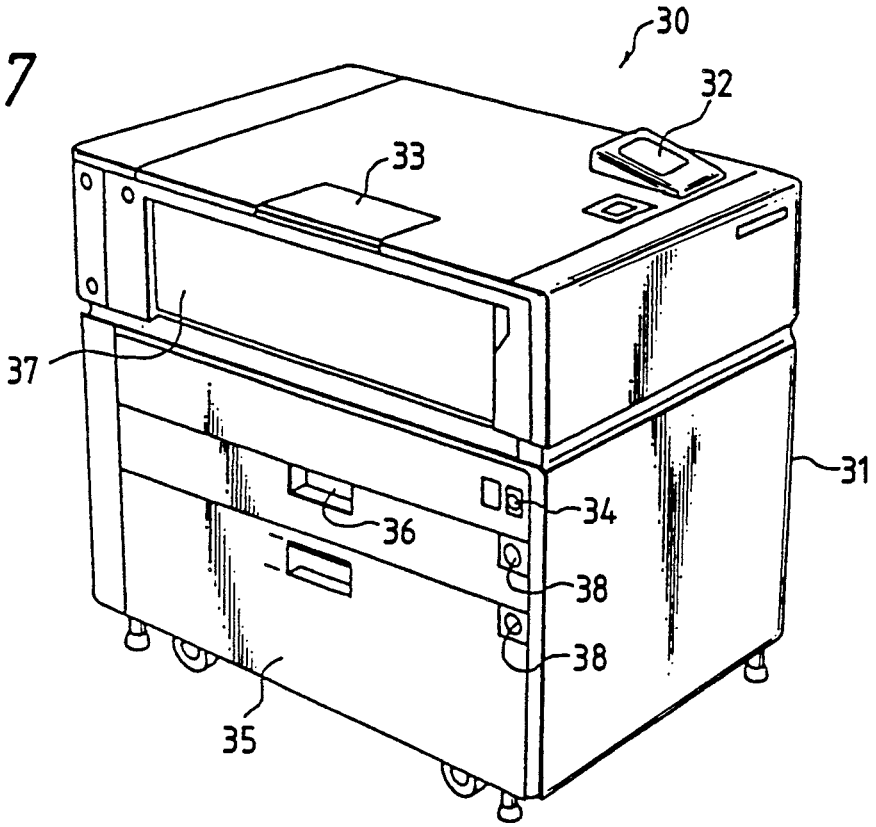
FIG. 7 is a perspective view showing an external appearance of an image forming apparatus to which the technical concept of the invention is applied.
Figure 8:
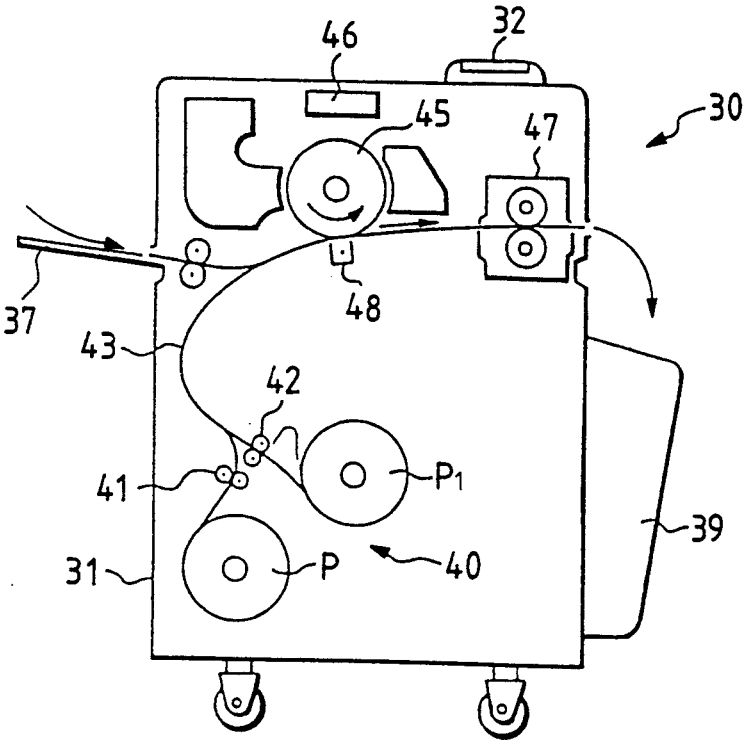
FIG. 8 is an explanatory diagram of the arrangement of the image forming apparatus.
Figure 9:
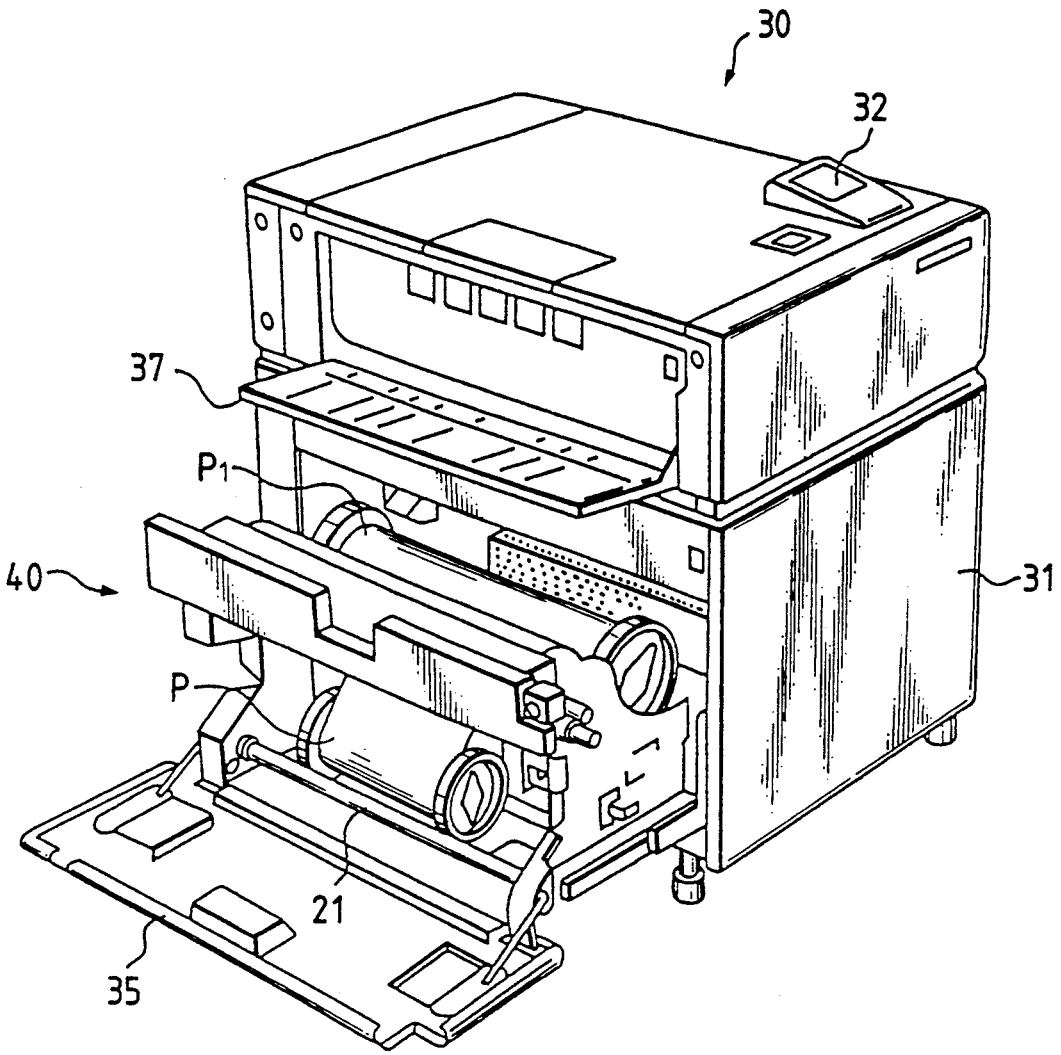
FIG. 9 is a perspective view of the image forming apparatus with its sheet supplying unit exposed.

FIGS. 7 through 9 shows an example of an image forming apparatus with the above-described roll-of-paper supporting and holding mechanism. FIG. 7 shows an external appearance of the image forming apparatus. Similarly, as in an ordinary copying machine, a control panel 32 is provided on the body 31 of the image forming apparatus 30, to control the formation of copies. A toner supplying door 33 is provided in the upper portion of the apparatus, to supply toner to the fixing unit.

A sheet supplying door 35, and a manual sheet supplying tray 37 are provided on one side of the image forming apparatus in such a manner that the former is located below and the latter is located above. In addition, a power switch 34, a lock lever 36, and a sheet cutting button 38 are provided on the same side.

As shown in FIG. 8, electronic photography processing mechanisms are arranged inside the image forming apparatus. More specifically, a write unit 46, a fixing unit 47, a transfer corotron 48, and cleaning unit are arranged around a photo-sensitive drum 45.

A sheet supplying unit 40 is provided in the lower portion of the apparatus body. A plurality of rolls of paper (two rolls of papers P and Pl in the embodiment) are provided in the sheet supplying unit 40. Cutters 41 and 42 are provided for the rolls of paper P and Pl, respectively. When one of the rolls of paper is selected, and a sheet of paper is drawn therefrom towards the sheet conveying path 43, or when the respective sheet cutting button 38 is operated, the paper is cut with the respective cutter.

In loading a roll of paper in the image forming apparatus, as shown in FIG. 9 the sheet supplying unit 40 is pulled out with the sheet supplying door 35 opened. In this operation, the flange of the roll of paper can be positioned with respect to the shafts 21 and 22 of the holding member 20 as shown in FIG. 3.

Hence, in the image forming apparatus of the invention, the sheet supplying operation can be achieved with ease. That is, a roll of paper can be loaded merely by setting the end supporting members on the holding member in the sheet supplying section which are connected to both ends of the roll of paper.

In the case of setting a plurality of rolls of paper in the sheet supplying unit in the image forming apparatus, the number of rolls of paper, the sizes of paper, and the kinds of paper thereof are not limited. For instance, in addition to a roll of paper large in size such as a roll of paper of A0 size, a roll of paper small in size such as a roll of paper of A3 may be employed.

The above-described supporting and holding device is applicable to a variety of systems, such as facsimile systems using rolls of paper, as well as apparatuses, such as electronic copying machines and printers.

The supporting and holding device of the invention comprises the above-described end supporting members. In each of the end supporting member, the main member and the auxiliary member can be made simple in construction. The end supporting members can be readily engaged with and disengaged from both ends of a roll of paper.

When the auxiliary members are turned engage the end supporting members with both ends of a roll of paper, the end supporting members can be correctly coupled to the roll of paper. The roll of paper thus supported can be accurately loaded in the sheet supplying section of a copying machine or the like.

The supporting and holding device of the invention can be accurately positioned with the aid of the flanges of its main members with respect to the sheet supplying unit of an image forming apparatus.

Other embodiments of the invention will be apparent to those skilled in the art from consideration of the specification and practice of the invention disclosed herein. It is intended hat the specification and examples be considered as exemplary only, with a true scope and spirit of the invention being indicated by the following claims.

What is claimed is:

1. An expansible end support member for supporting and holding a roll of paper, the roll of paper including a core having at least one open end, the end support member comprising:

a main member configured to be partially inserted into said open end of the core, said main member including a plurality of arm members configured to be inserted into said open end of the core, and a first flange member integral with said plurality of arm members, said first flange member configured to abut the roll of paper when said plurality of arm members are inserted into said open end, said first flange member having an axial throughhole extending therethrough, said plurality of arm members integrally extending from said first flange member and spaced along a periphery of said axial throughhole; and an auxiliary member configured to be at lest partially inserted into said main member, said auxiliary member including a second flange member, a pipe-shaped member integral with said second flange member, said pipe-shaped member configured to be inserted into said axial through-hole, said pipe-shaped member having a set of first protrusion members provided thereon to push said plurality of arm members against an inner wall of the core when said pipe-shaped member is inserted into said axial through-hole and said auxiliary member is selectively rotated through a predetermined angle, thereby securing the end support member in said open end of the core, and at least one outer pawl member provided on said pipe-shaped member proximate said second flange.

2. The end support member according to claim 1, wherein each arm member of said plurality of arm members has a second protrusion member provided thereon to confront said inner wall of said core when said set of first protrusions push said plurality of arm members against said inner wall.

3. The end support member according to claim 1, wherein said set of first protrusion members and said at lest one outer pawl member are equal in number and aligned on said auxiliary member with each other.

4. The end support member according to claim 1, wherein at least one inner pawl member is provided on an inner wall of said axial through-hole, said at least one outer pawl member configure to selectively engage said at least one inner pawl member to prevent said auxiliary member from inadvertently separating from said member.

5. The end support member according to claim 1, wherein said first flange member is circular in shape and includes an outer circumferential edge configured to extend radially beyond the roll of paper.

6. A supporting and holding device for a roll of sheet material for use in an image forming apparatus, the roll of sheet material including a core having at least one open end, the device comprising:

an end support member configured to be secured to the roll of sheet material, said end support member including a main member configured to be partially inserted into said open end of the core, said main member having a first flange member with an axial through-hole extending therethrough, and a plurality of arm members integrally extending from said first flange member and spaced along a periphery of said axial through-hole, said plurality of arm members configured to be inserted into said open end of the core with said first flange member abutting the roll of paper, and an auxiliary member configured to be at least partially inserted into said main member, said auxiliary member having a second flange member, a pipe-shaped member integral with said second flange member and configured to be inserted into said axial through-hole of said main member, wherein said pipe-shaped member has a set of first protrusion members provided thereon to push said plurality of arm members against an inner wall of the core when said pipe-shaped member is inserted into said axial through-hole and said auxiliary member is selectively rotated through a predetermined angle, thereby securing said end support member in said open end of the core, and at least one outer pawl member provided on said pipe-shaped member proximate said second flange; and means for holding said end support member to permit selected lengths of sheet material to be drawn from the roll of sheet material.

7. The supporting and holding device according to claim 6, wherein said first flange member is circular in shape and includes an outer circumferential edge which extends radially beyond the roll of sheet material; and further wherein said holding means holds said end support member along said outer circumferential edge to enable said selected lengths of sheet material to be drawn from the roll of sheet material.

8. The supporting and holding device according to claim 7, wherein said holding means includes a plurality of rotatable shafts for holding said outer circumferential edge of said first flange member; and at least one slide bearing for supporting at least one of said shafts, the weight of said roll of sheet material enabling said at least one slide bearing to appropriately apply rotational resistance to said at least one shaft for drawing said selected lengths of sheet material from said roll of sheet material.

9. The supporting and holding device according to claim 6, wherein the core has a second open end; and the device further comprises:

a second end support member configured to be secured to the roll of sheet material in said second open end.

* * * * *

UNITED STATES PATENT AND TRADEMARK OFFICE

CERTIFICATE OF CORRECTION

PATENT NO. : 5,267,704

DATED : December 07, 1993

INVENTOR(S) : Michio Kitamura et al.

It is certified that error appears in the above-indentified patent and that said Letters Patent is hereby corrected as shown below:

Abstract, Item [57] line 9, change "members" to --member--.

Abstract, Item [57] line 15, delete both occurences "is to be".

Abstract, Item [57] line 16, delete ";".

Claim 1, column 8, line 60, change "throughhole" to --through-hole--.

UNITED STATES PATENT AND TRADEMARK OFFICE

CERTIFICATE OF CORRECTION

PATENT NO. : 5,267,704

DATED : December 7, 1993

INVENTOR(S) : Michio Kitamura,et al

It is certified that error appears in the above-indentified patent and that said Letters Patent is hereby corrected as shown below:

Claim 1, column 8, line 61, change "lest" to --least --.

Claim 3, column 9, line 19, change "lest" to --least --.

Claim 4, column 9, line 24, change "configure" to --configured --.

Signed and Sealed this

Sixth Day of September, 1994

Bruce Lehman

*Attest:*

BRUCE LEHMAN

*Attesting Officer*

*Commissioner of Patents and Trademarks*